US011506096B2

(12) United States Patent
Ballatore et al.

(10) Patent No.: US 11,506,096 B2
(45) Date of Patent: Nov. 22, 2022

(54) EXHAUST SYSTEM FOR AN INTERNAL COMBUSTION ENGINE

(71) Applicant: FERRARI S.p.A., Modena (IT)

(72) Inventors: Marco Ballatore, Modena (IT); Francesco Fabbri, Modena (IT)

(73) Assignee: FERRARI S.P.A., Modena (IT)

( * ) Notice: Subject to any disclaimer, the term of this patent is extended or adjusted under 35 U.S.C. 154(b) by 52 days.

(21) Appl. No.: 17/223,041

(22) Filed: Apr. 6, 2021

(65) Prior Publication Data

US 2021/0317769 A1 Oct. 14, 2021

(30) Foreign Application Priority Data

Apr. 9, 2020 (IT) ..... 102020000007627

(51) Int. Cl.
*F01N 1/16* (2006.01)
*F01N 1/18* (2006.01)
*F01N 13/20* (2010.01)

(52) U.S. Cl.
CPC ..... *F01N 1/165* (2013.01); *F01N 1/18* (2013.01); *F01N 13/20* (2013.01); *F01N 2240/36* (2013.01); *F01N 2410/10* (2013.01)

(58) Field of Classification Search
CPC ..... F01N 1/165; F01N 1/166; F01N 1/168; F01N 1/18; F01N 13/20; F01N 2240/36; F01N 2260/14; F01N 2410/10
See application file for complete search history.

(56) References Cited

U.S. PATENT DOCUMENTS

| | | | | |
|---|---|---|---|---|
| 1,483,354 | A | 2/1924 | Kopper, Jr. | |
| 1,709,426 | A * | 4/1929 | Josephc | F01N 1/166 181/254 |
| 2010/0025146 | A1 | 2/2010 | Ho | |
| 2016/0123210 | A1* | 5/2016 | Dmytrow | F01N 1/168 137/599.11 |
| 2018/0258817 | A1* | 9/2018 | Kosuge | F02D 41/0007 |
| 2020/0049040 | A1* | 2/2020 | Drees | F01N 1/168 |

FOREIGN PATENT DOCUMENTS

| | | | |
|---|---|---|---|
| EP | 3141720 | A1 | 3/2017 |
| GB | 2274681 | A | 8/1994 |
| KR | 1020160108625 | A | 9/2016 |

OTHER PUBLICATIONS

Search Report and Written Opinion for Italian Application No. 202000007627, dated Aug. 14, 2020, 8 pages.

* cited by examiner

*Primary Examiner* — Jonathan R Matthias
(74) *Attorney, Agent, or Firm* — Cantor Colburn LLP

(57) ABSTRACT

An exhaust system for an internal combustion engine and having at least an exhaust duct, which originates from the internal combustion engine and has an end part, which ends with an outlet opening, through which exhaust gases are released into the atmosphere. The end part of the exhaust duct has at least one movable wall, which can be moved to different positions to vary the width of the outlet opening. There are provided a motor-driven actuator device, which is configured to move the movable wall and can be electronically controlled, and a control unit, which is configured to vary, by controlling the actuator device, the position of the movable wall depending on a rotation speed of the internal combustion engine and on an engine load of the internal combustion engine.

25 Claims, 7 Drawing Sheets

EXHAUST SYSTEM FOR AN INTERNAL COMBUSTION ENGINE

CROSS-REFERENCE TO RELATED APPLICATIONS

This Patent Application claims priority from Italian Patent Application No. 102020000007627 filed on Apr. 9, 2020, the entire disclosure of which is incorporated herein by reference.

TECHNICAL FIELD

The invention relates to an exhaust system for an internal combustion engine.

PRIOR ART

Car type approval rules force manufacturers to limit the level of sound emissions, especially when the car drives at moderate speeds (namely, when it drives through city centres). As a consequence, the exhaust system (which fulfils the function of releasing the gases produced by the combustion into the atmosphere, limiting both the noise and the content of polluting substances) is always provided with at least one silencer, which is arranged along an exhaust duct downstream of the pollutants reducing devices.

Generally speaking, a silencer comprises a tubular body, which typically has an elliptical cross section and is provided with an inlet opening and with an outlet opening. Inside the tubular body there is defined a labyrinth, which determines a path for the exhaust gases from the inlet opening to the outlet opening; said labyrinth normally consists of diaphragms (or partitions), which are arranged crosswise (namely, perpendicularly to the longitudinal axis of the tubular body) so as to define chambers inside the tubular body, and of tubes, which connect the chambers to one another. In a traditional silencer ensuring a high damping of the noise at low engine speeds, the exhaust back pressure generated by the silencer (i.e. the loss of pressure caused in the exhaust gases when they flow through the silencer) exponentially grows as the number of revolutions per minute of the internal combustion engine increases (i.e. as the mean speed of the exhaust gases increases). As a consequence, in order to avoid too high exhaust back pressure values at high engine speeds (hence, excessively jeopardizing performances at high engine speeds), a bypass duct is provided, which is arranged in parallel to the silencer (namely, is designed to bypass the silencer) and is regulated by a bypass valve, which is kept closed at low engine speeds (so as to maximize the silencing action, sacrificing performances, which, anyway, are nor essential at low engine speeds) and is opened at high engine speeds (so as to reduce the exhaust back pressure, sacrificing the silencing, which should not be primarily important when the internal combustion engine rotates at high speeds).

Furthermore, in a high-performance sports car, the noise of the internal combustion engine perceived inside the passenger compartment is highly important. In particular, a significant component in the judgement of a high-performance sports car is the "quality" of the sound emitted by the exhaust system (not only and not primarily in terms of intensity of the sound, but especially in terms of "likeability" of the emitted sound), namely the degree of satisfaction in the use of a high-performance sports car is significantly influenced also by the "quality" of the sound emitted by the exhaust system. However, known exhaust systems with a variable geometry (i.e. provided with one or more electrically or pneumatically controlled valves, which can change the path of the exhaust gases and, hence, of the sound along the exhaust system) do not always ensure that the sound emitted by the exhaust system corresponds to users' expectations.

Generally speaking, turbocharged engines are disadvantaged as the presence of the turbine along the exhaust duct and of the compressor along the intake duct add a filter and a lowering of the sound levels both of the exhaust system and of the intake system.

Furthermore, recent EURO6C emission standards establish the use of exhaust gas treatment devices that significantly jeopardize sound performances, as a particulate filter (also called GPF, i.e. "Gasoline Particulate Filter") must necessarily be present in series to the catalytic converter, even in petrol engines.

Patent documents U.S. Pat. No. 1,483,354A, KR20160108625A and GB2274681A describe an exhaust system for an internal combustion engine, wherein an exhaust duct, which originates from the internal combustion engine, has an end part, which ends with an outlet opening, through which exhaust gases are released into the atmosphere; the end part of the exhaust duct has at least one movable wall, which can be moved to different positions to vary the width of the outlet opening. In particular, the movement of the movable wall can be carried out manually (as described in U.S. Pat. No. 1,483,354A) or can automatically take place because of the pressure of the exhaust gases and against the elastic thrust generated by a spring that tends to minimize the width of the outlet opening (as described in KR20160108625A and GB2274681A).

DESCRIPTION OF THE INVENTION

The object of the invention is to provide an exhaust system for an internal combustion engine; said exhaust system allows manufacturers to obtain, in all operating conditions, a natural exhaust noise capable of meeting the expectations of the driver and of possible passengers and, at the same time, complies with type approval rules and does not jeopardize performances.

According to the invention, there is provided an exhaust system for an internal combustion engine according to the appended claims.

The appended claims describe preferred embodiments of the invention and form an integral part of the description.

BRIEF DESCRIPTION OF THE DRAWINGS

The invention will now be described with reference to the accompanying drawings, which show some non-limiting embodiments thereof, wherein.

PREFERRED EMBODIMENTS OF THE INVENTION

Figure 1:
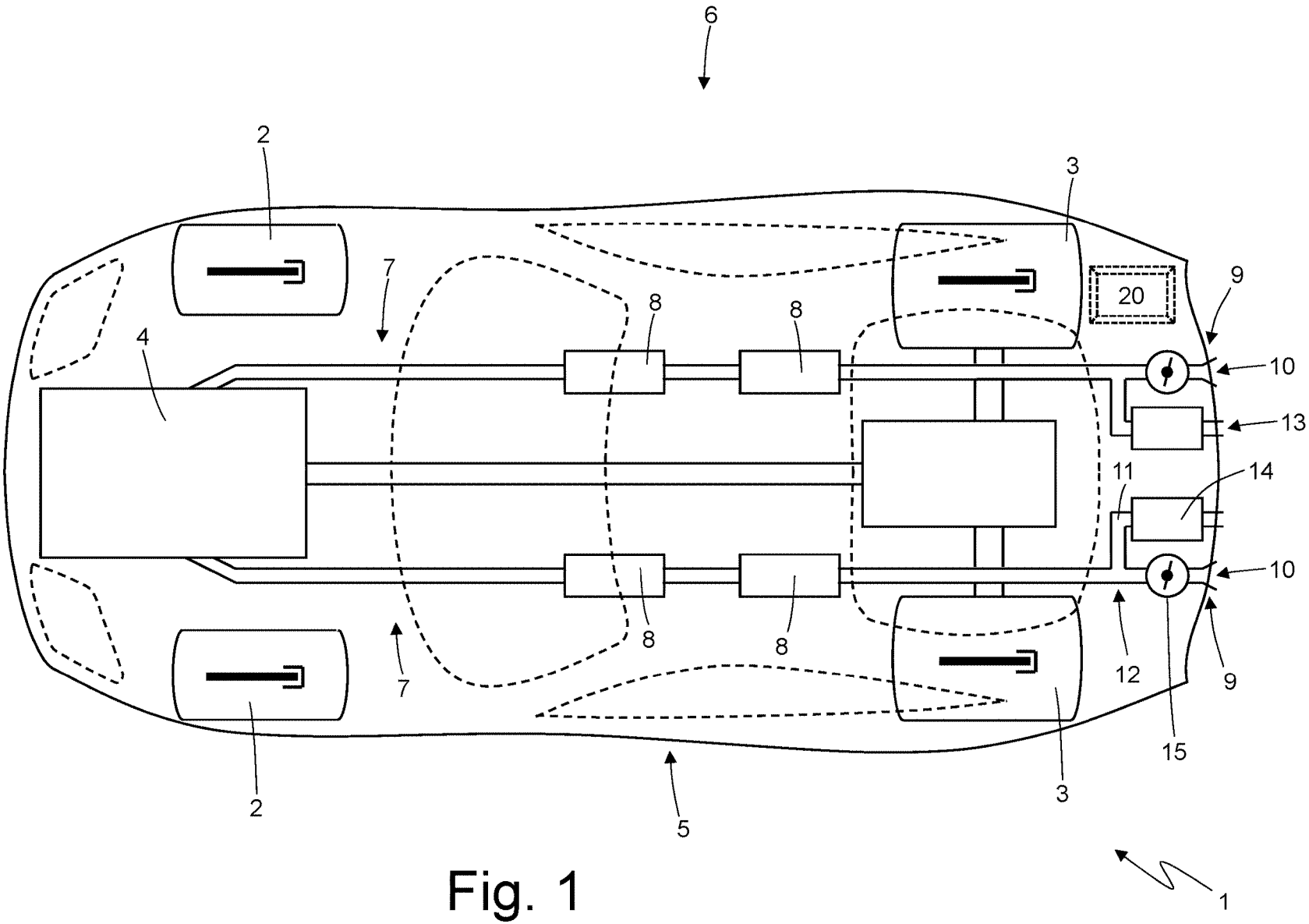
FIG. 1 is a schematic view of a car, which is driven by an internal combustion engine provided with an exhaust system according to the invention.

In FIG. 1, number 1 indicates, as a whole, a car provided with two front wheels 2 and with two rear drive wheels 3, which receive the torque from an internal combustion engine 4 supercharged by means of a turbocharger and arranged in a front position. The car 1 is provided with a passenger compartment 5 which is designed to house the driver and possible passengers.

According to a possible, though non-binding embodiment, the internal combustion engine 4 is a "V8" engine and has two (twin) banks with four cylinders arranged at an angle relative to one another so as to form a "V". In each bank, the four cylinders are connected to an intake manifold (not shown) by means of two intake valves and to an exhaust manifold (not shown) by means of two exhaust valves; each exhaust manifold collects the gases produced by the combustion, which cyclically flow out through the exhaust valves.

The internal combustion engine 4 is provided with an exhaust system 6, which has the function of releasing the gases produced by the combustion into the atmosphere limiting both the noise and the content of polluting substances. The exhaust system 6 comprises two twin exhaust ducts 7, each originating from a corresponding exhaust manifold, so to receive the gases produced by the combustion from the exhaust manifold, and ending in the area of the tail of the car 1. Along each exhaust duct 7 there are known exhaust gas treatment devices 8: there always is at least one catalytic converter and there could also be a particulate filter (in order to comply with the new EURO6C standards on polluting emissions, car manufacturers use a particulate filter called GPF, which stands for "Gasoline Particulate Filter"—also in gasoline engines).

Each exhaust duct 7 (which originates from the internal combustion engine 4) has an end part 9, which ends with an outlet opening 10, through which the exhaust gases are released into the atmosphere.

The system 6 comprises two additional exhaust ducts 11 (namely, in addition to the two exhaust ducts 7), each originating from a corresponding exhaust duct 7 in the area of a junction 12 and having an outlet opening 13, through which the exhaust gases are released into the atmosphere. In other words, each additional exhaust duct 11 is an alternative to the last segment of a corresponding exhaust duct 7. Along each additional exhaust duct 11 there is (at least) a traditional silencing device 14, which, for example, consists of a tubular body with an elliptical cross section, which is provided with an inlet opening, with an outlet opening and with an inner labyrinth determining a path for the exhaust gases from the inlet opening to the outlet opening. On the other hand, each exhaust duct 7 is not provided with any traditional silencing device.

The system 6 comprises two regulation valves 15, each arranged along a corresponding exhaust duct 7 downstream of the junction 12 from which the exhaust duct 11 originates (namely, between the junction 12 from which the exhaust duct 11 originates and the end part 9) and designed to adjust the exhaust gas flow towards the end part 9 of the exhaust duct 7. In particular, the regulation valves 15 are moved towards a fully closed position in order to prevent the exhaust gases from flowing into the last segment of the exhaust ducts 7, hence forcing the exhaust gases to flow through the exhaust ducts 11, which are provided with the silencing devices 14 and, as a consequence, damp the noise to a greater extent and have a greater back pressure; vice versa, the regulation valves 15 are moved towards a fully open position in order to direct the exhaust gas flow towards the last segment of the exhaust ducts 7 (the exhaust ducts 11 do not need to be closed, since the greater back pressure determined by the silencing devices 14 minimizes the exhaust gas flow along the exhaust ducts 11 when a freer alternative route is available).

Figure 2:
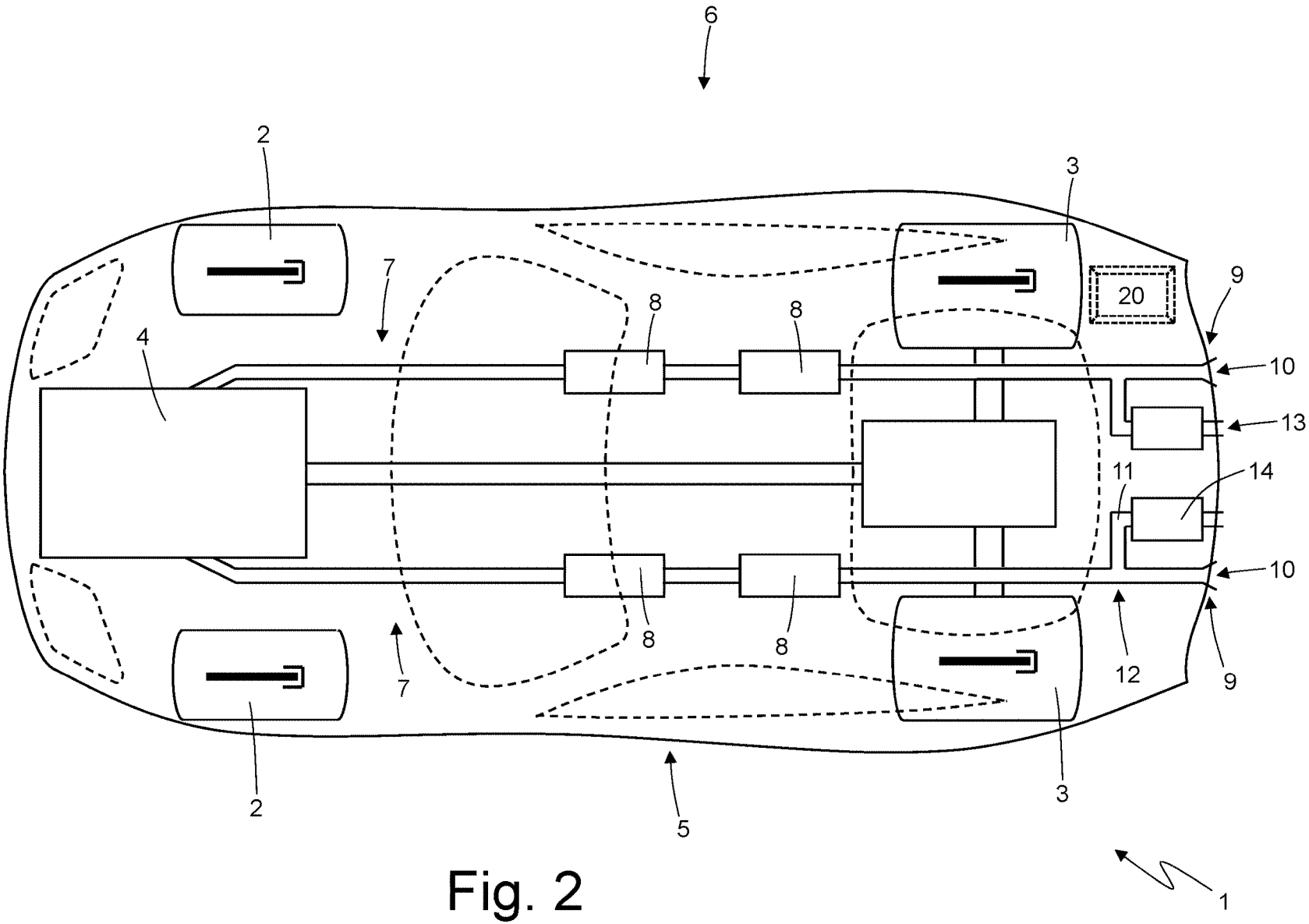
FIGS. 2, 3 and 4 are schematic views of the car of FIG. 1 with respective variants of the exhaust system.

In the variant shown in FIG. 2, there are no regulation valves 15 and their function (namely, adjusting the exhaust gas flow towards the end part 9 of the exhaust duct 7) is directly carried out by the variable geometry (described below) of the end parts 9 of the exhaust ducts 7.

Figure 3:
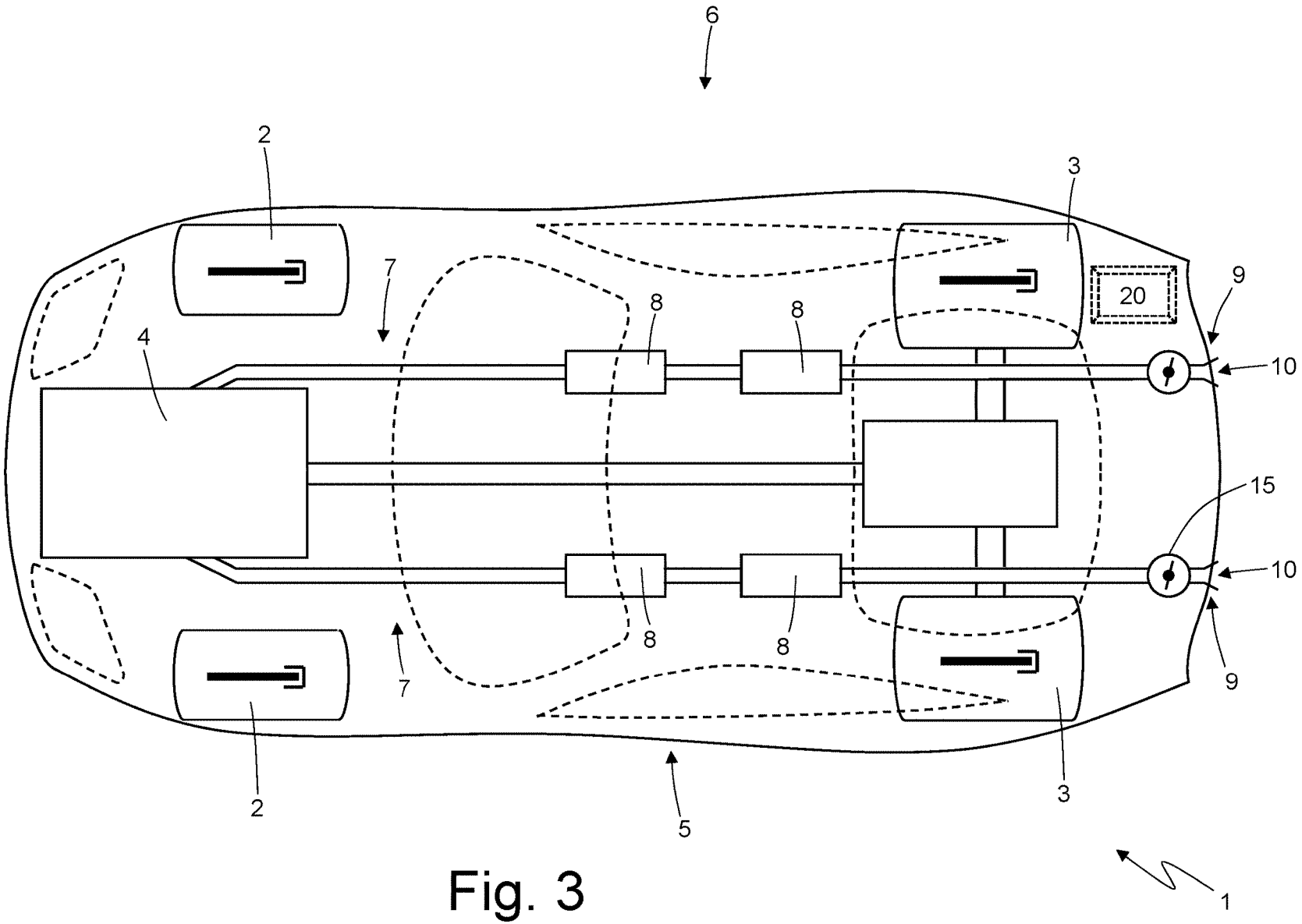

In the variant shown in FIG. 3, there are no exhaust ducts 11 (and, hence, no relative silencing devices 14), but, on the other hand, there are the regulation valves 15, each intercepting an exhaust duct 7 and movable between a fully open position and a fully closed position.

In this embodiment, the regulation valves 15 have the sole function of reducing the transmission of noise towards the outlet openings 10 and, hence, in the fully closed position, the regulation valve 15 has a free section for the passage of the exhaust gases having a non-zero area so that the exhaust gases can flow through the regulation valve 15 even when the valve 15 is in the fully closed position.

In the variant shown in FIG. 4, there are neither the exhaust ducts 11 (and, hence, the relative silencing devices 14) nor the regulation valves 15; as a consequence, the entire management of the sound damping strategies is completely assigned to a variable geometry (described below) of the end parts 9 of the exhaust ducts 7.

According to FIGS. 5-10, the end part 9 of each exhaust duct 7 has two movable walls 16 opposite and facing one another, which can be moved to different positions (as it appears evident comparing FIGS. 5-8). In each end part there is provided a motor-driven actuator device 17 (namely, provided with a preferably electric or pneumatic motor, which is designed to actively generate a movement), which is configured to move the movable walls 16; preferably, each actuator device 17 is configured to move the two movable walls 16 together in opposite direction so as to move the two movable walls 16 apart or to move the movable walls 16 close to one another. In other words, each motor-driven actuator device 17 is active and is electronically (electrically) controlled so as to generate a force (torque) that determines a movement of the movable walls 16; as a consequence, in each end part 9, the position of the movable walls 16 is adjustable (by controlling the corresponding actuator device 17) completely independently of the pressure and the flow rate of the exhaust gases flowing through the end part 9 (for example, the movable walls 16 can be moved so as to have a very large outlet opening 10 when the pressure and the flow rate of the exhaust gases are moderate and can be moved so as to have a very small outlet opening 10 when the pressure and the flow rate of the exhaust gases are high).

According to a preferred embodiment, each movable wall 16 is hinged so as to rotate around a rotation axis 18; as a consequence, each actuator device 17 is configured to always rotate the two movable walls 16 in opposite directions around the respective rotation axes 18 (in this way, the movement of the two movable walls 16 causes the two movable walls 16 to move apart from one another or it causes the two movable walls 16 to move close to one another).

Figure 8:
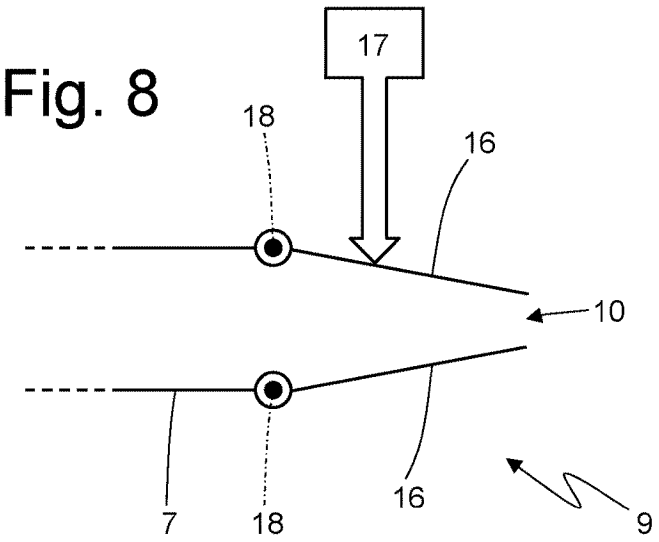
Figure 7:
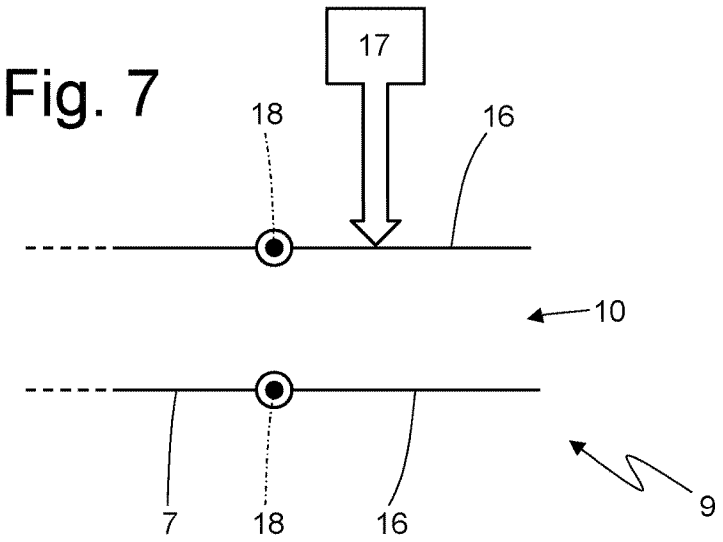

In the end part 9 of each exhaust duct 7, the two movable walls 16 can be moved between a maximum expansion position (shown, for example, in FIG. 5) and a minimum expansion position (shown, for example, in FIG. 8); obviously, when the two movable walls 16 are in the maximum expansion position (shown, for example, in FIG. 5), an area of the outlet opening 10 is (significantly) greater than an area of the outlet opening 10 when the two movable walls 16 are in the minimum expansion position (shown, for example, in FIG. 8).

In the maximum expansion position (shown, for example, in FIG. 5) or even in other expansion positions (shown, for example, in FIG. 6), the two movable walls 16 confer to the end part 9 of the exhaust duct 7 a divergent conformation, which progressively increases an area of a cross section approaching the outlet opening 10; namely, in the maximum expansion position (shown in FIG. 5) or even in other expansion positions (shown, for example, in FIG. 6), the two movable walls 16 confer to the end part 9 of the exhaust duct 7 the shape of a trumpet.

According to a possible embodiment, in the minimum expansion position (shown in FIG. 7), the two movable walls 16 confer to the end part 9 of the exhaust duct 7 a parallel conformation, which maintains constant an area of a cross section approaching the outlet opening 10 (basically, the two movable walls 16 are arranged parallel to the walls of the preceding part of the exhaust duct 7 so as not to determine any significant variation in the area of the cross section).

According to an alternative embodiment, in the minimum expansion position (shown in FIG. 8), the two movable walls 16 confer to the end part 9 of the exhaust duct 7 a convergent conformation, which progressively reduces an area of a cross section approaching the outlet opening 10.

Each actuator device 17 is capable of placing and holding the two movable walls 16 in intermediate positions between the maximum expansion position (shown, for example, in FIG. 5) and the minimum expansion position (shown, for example, in FIG. 8).

Figure 9:
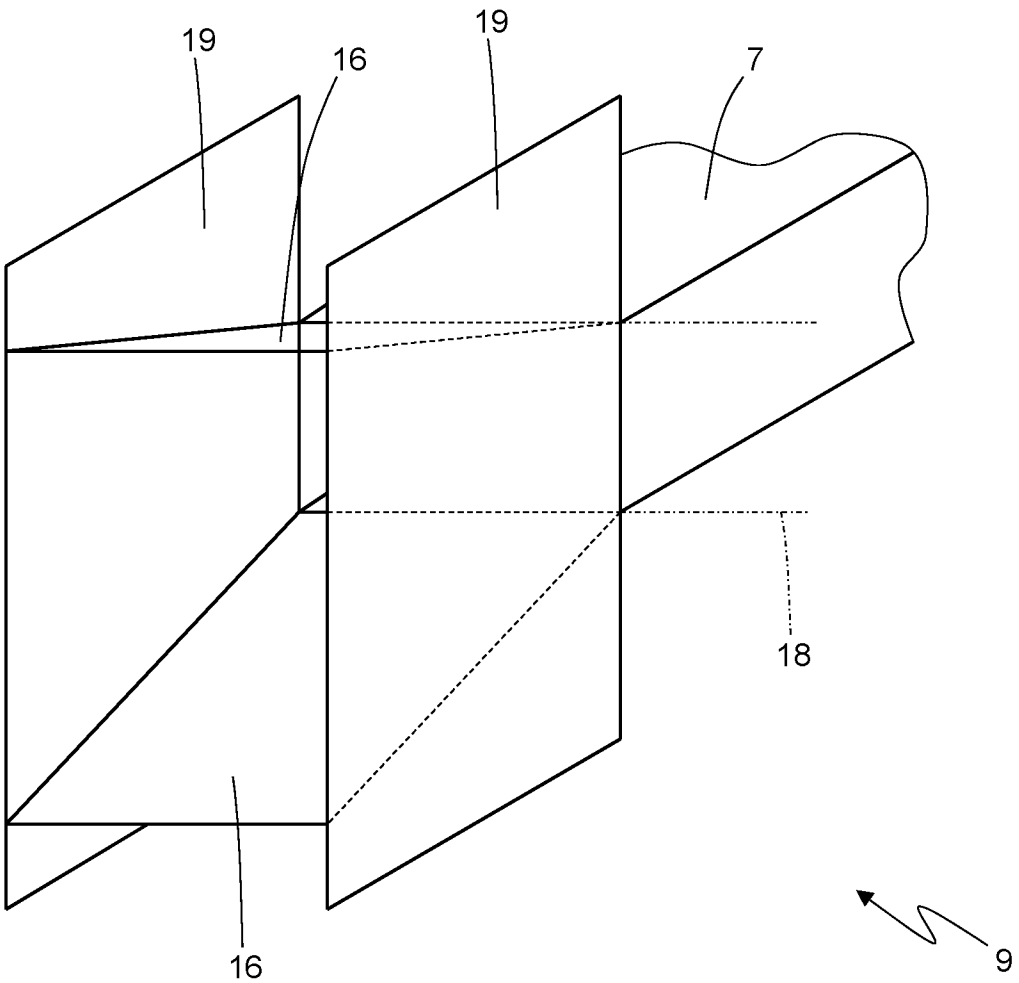
FIG. 9 is a schematic perspective view of the end part of FIG. 5.
Figure 10:
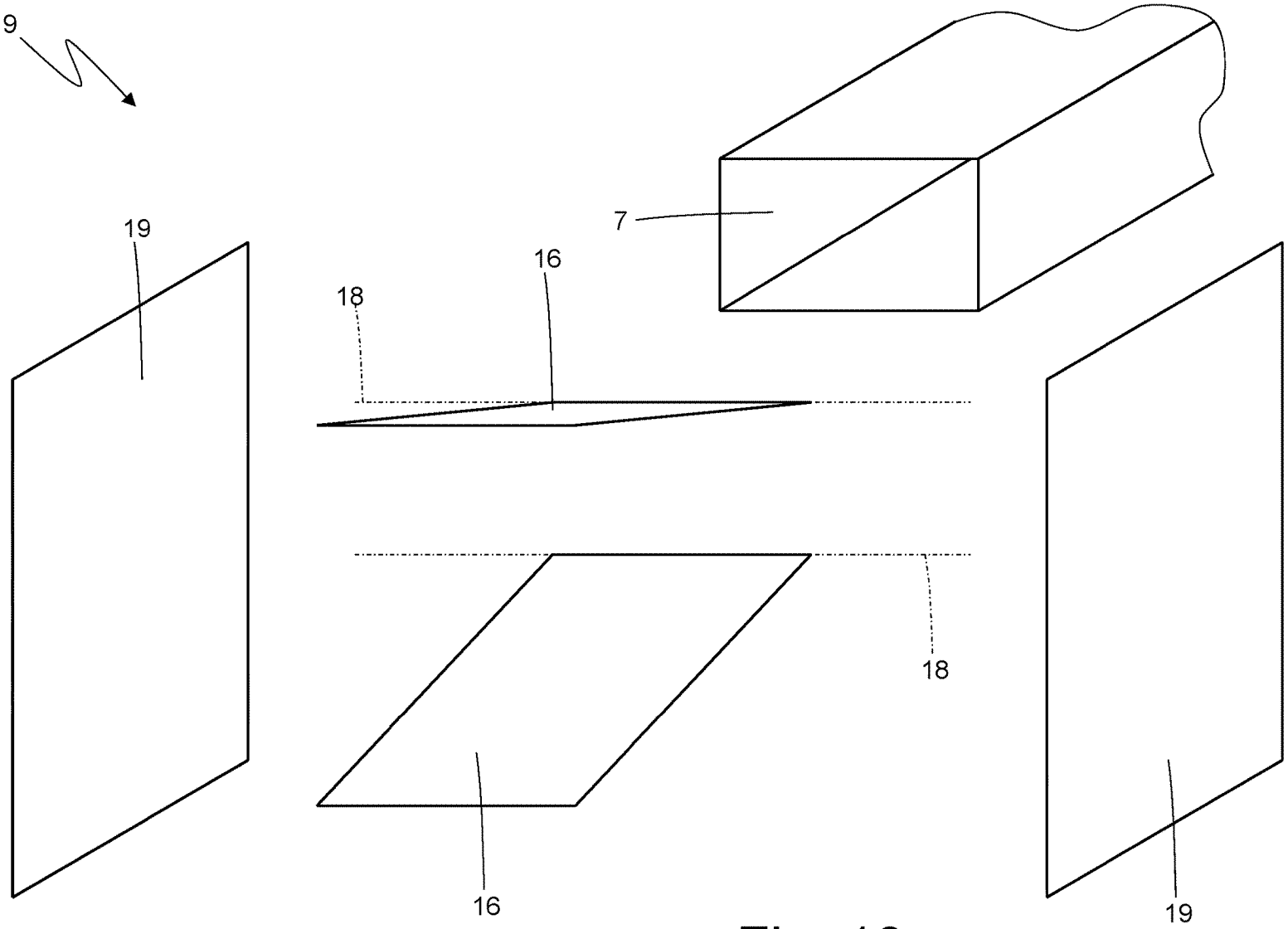
FIG. 10 is a schematic perspective exploded view of the end part of FIG. 5.

According to a possible embodiment shown in FIGS. 9 and 10, in each end part 9: the two movable walls 16 face and are opposite one another and are hinged so as to rotate around two respective rotation axes 18 parallel to one another, there are two fixed walls 19 (namely, rigidly connected to a support structure and, hence, incapable of any type of movement), which are parallel to one another and perpendicular to the rotation axes 18, and the two movable walls 16 are enclosed between the fixed walls 19 and crawl on the fixed walls 19 when they move. In each end part 9, the two fixed walls 19 could also be connected to one another so as to form a "U"-shaped structure containing, on the inside, the two movable walls 16 or so as to form a structure closed in a ring shape and containing, on the inside, the two movable walls 16.

In the embodiment shown in the accompanying figures, the end part 9 of each exhaust duct 7 has two movable walls 16 facing and opposite one another; according to different embodiments which are not shown herein, the end part 9 of each exhaust duct 7 has one single movable wall 16 or three or more movable walls 16.

As already mentioned above, each exhaust duct 7 lacks any traditional silencing device (namely, other than the movable walls 16 and arranged upstream of the movable walls 16).

There is also provided a control unit 20 (schematically shown in FIGS. 1-4), which is configured to change the position of the movable walls 16 of each end part 9 (by controlling the corresponding actuator device 17) depending on: a rotation speed of the internal combustion engine 4, an engine load of the internal combustion engine 4, a gear engaged in a gearbox coupled to the internal combustion engine 4, a longitudinal speed of a car 1 equipped with the internal combustion engine 4, and a longitudinal acceleration of the car 1 equipped with the internal combustion engine 4.

Namely, the control unit 20 is configured to detect (for example, by reading them from the BUS network of the car): the rotation speed of the internal combustion engine 4, the engine load of the internal combustion engine 4, the gear engaged in the gearbox, the longitudinal speed of the car, and the longitudinal acceleration of the car 1; knowing this information (which is read beforehand), the control unit 20 can establish the position of the movable walls 16 of each end part 9 depending on this information.

The control unit 20 could be configured to change the position of the movable walls 16 of each end part 9 also depending on the driving mode selected by the driver (namely, it can be a sports driving mode, a racing driving mode, a city driving mode, a motorway driving mode, a wet-road driving mode . . . , which is generally selected by the driver by acting upon a selector called "hand lever").

According to a preferred embodiment, the control unit 20 is configured to move the movable wall 16 of each end part 9 towards a minimum expansion position at low rotation speeds and at low engine loads of the internal combustion engine 4 and to move the movable walls 16 of each end part 9 towards a maximum expansion position at high rotation speeds and high engine loads of the internal combustion engine 4. Furthermore, the control unit 20 is configured to move the movable walls 16 of each end part 9 towards a minimum expansion position in low gears and to move the movable walls 16 of each end part 9 towards a maximum expansion position in high gears.

According to a preferred embodiment, in the control unit 20 there are stored different maps (each corresponding to one or more driving modes), which provide, as an output, the desired (ideal) position of the movable walls 16 of each end part 9 based on the data provided as an input on the rotation speed and on the engine load of the internal combustion engine 4 as well as on the gear engaged in the gearbox coupled to the internal combustion engine 4. Obviously, each map stored in the control unit 20 comprises a limited number of points and, therefore, the control unit 20 could carry out interpolations between the closest points of a map in order to determine the desired (ideal) position of the movable walls 16 of each end part 9.

In the maximum expansion position (shown, for example, in FIG. 5), the "open" namely "divergent" position of the movable walls 16 of each end part 9 confers to the exhaust duct 7 the minimum exhaust back pressure (namely, it maximizes performances) and also confers to the exhaust duct 7 the minimum exhaust noise damping ability; on the other hand, in the minimum expansion position (shown, for example, in FIG. 8), the "closed" namely "convergent" position of the movable walls 16 of each end part 9 confers to the exhaust duct 7 the maximum exhaust back pressure (namely, it jeopardizes performances to a greater extent) and also confers to the exhaust duct 7 the maximum exhaust noise damping ability.

The control unit 20 is configured to move the movable walls 16 of each end part 9 towards the minimum expansion position (shown, for example, in FIG. 8) when it is necessary (useful) to favour silencing rather than performances and to move the movable walls 16 of each end part 9 towards the maximum expansion position (shown, for example, in FIG. 5) when it is necessary (useful) to favour performances rather than silencing.

In the embodiments shown in the accompanying figures, the internal combustion engine 4 has eight cylinders 6 arranged in a V shape. Obviously, the internal combustion engine could have a different number of cylinders and/or a different arrangement of the cylinders; in case of internal combustion engines with inline cylinders (hence, with one single bank of cylinders), there usually is one single exhaust duct 7 and, therefore, one end part 9.

In the embodiments shown in the accompanying figures, the internal combustion engine 4 is supercharged; according to other embodiments which are not shown herein, the internal combustion engine 4 is not supercharged, namely it is an aspirated engine.

The embodiments described herein can be combined with one another, without for this reason going beyond the scope of protection of the invention.

The exhaust system 6 described above has numerous advantages.

First of all, the exhaust system 6 described above allows for an ideal silencing at low engine speeds and, at the same time, allows the exhaust back pressure to be minimized at high engine speeds.

In particular, the exhaust system 6 descried above, by properly adjusting the width of each outlet opening 10 (namely, by properly adjusting the sound amplification/damping ability of each variable geometry end part 9) allows for an optimization, in any possible operating condition, of the frequency response of each variable geometry end part 9.

Figure 4:
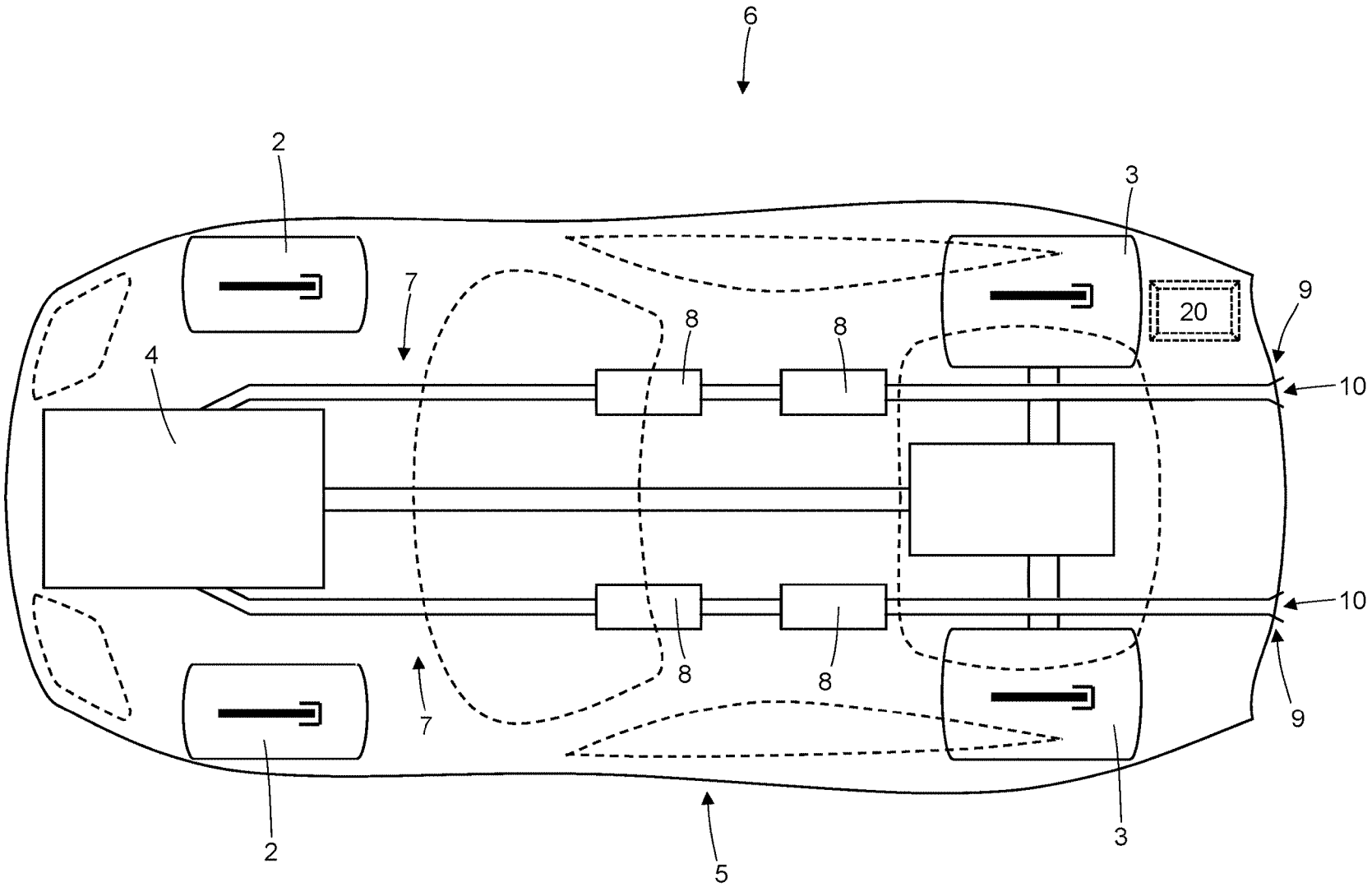
Figure 6:
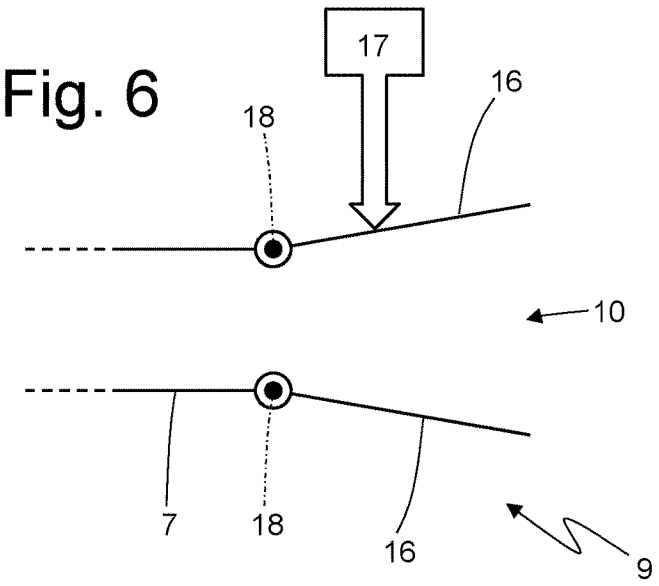
FIGS. 6, 7 and 8 are schematic views of the end part of FIG. 4 with the movable walls in different positions.
Figure 5:
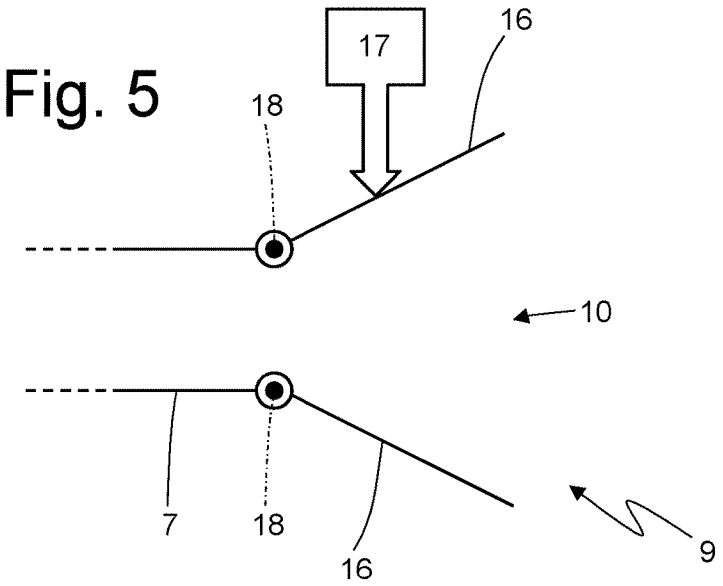
FIG. 5 is a schematic view of an end part provided with two movable walls of an exhaust duct of the exhaust system of FIGS. 1-4.

Furthermore, the exhaust system 6 described above is particularly light and compact (especially in the embodiments shown in FIGS. 3 and 4, which do not comprise the silencing devices 14).

Finally, the exhaust system 6 described above is easy and inexpensive to be manufactured, since, compared so a similar traditional exhaust system 6, it requires the addition of a few small-sized pieces which can easily be manufactured.

LIST OF THE REFERENCE NUMBERS OF THE FIGURES

1 car
2 front wheels
3 rear wheels
4 internal combustion heat engine
5 passenger compartment
6 exhaust system
7 exhaust duct
8 treatment devices
9 end part
10 outlet opening
11 exhaust duct
12 junction
13 outlet opening
14 silencing device
15 regulation valve
16 movable walls
17 actuator device
18 rotation axis
19 fixed walls
20 control unit

The invention claimed is:

1. An exhaust system (6) for an internal combustion engine (4) and comprising:

at least one first exhaust duct (7) which originates from the internal combustion engine (4) and has an end part (9) which ends with a first outlet opening (10) through which the exhaust gases are released into the atmosphere; wherein the end part (9) of the first exhaust duct (7) has at least one movable wall (16) which delimits the end part (9) of the first exhaust duct (7) and can be moved to different positions to vary the width of the outlet opening (10) so that to confer to the end part (9) of the exhaust duct (7) a convergent conformation or a divergent conformation;

a motor-driven actuator device (17), which is configured to actively move the movable wall (16) and can be electronically controlled; and a control unit (17), which is configured to vary, by controlling the actuator device (17), the position of the movable wall (16) depending on a rotation speed of the internal combustion engine (4) and on an engine load of the internal combustion engine (4).

2. The exhaust system (6) according to claim 1, wherein the movable wall (16) can be moved towards a maximum expansion position in which the movable wall (16) confers to the end part (9) of the first exhaust duct (7) a divergent conformation which progressively increases an area of a cross section approaching the first outlet opening (10).

3. The exhaust system (6) according to claim 1, wherein:

the movable wall (16) can be moved between a maximum expansion position and a minimum expansion position; and in the maximum expansion position the movable wall (16) gives the end part (9) of the first exhaust duct (7) a divergent conformation which progressively increases an area of a cross section approaching the first outlet opening (10).

4. The exhaust system (6) according to claim 3, wherein in the position of minimum expansion the movable wall (16) gives the end part (9) of the first exhaust duct (7) a parallel conformation which maintains constant an area of a cross section approaching the first outlet opening (10).

5. The exhaust system (6) according to claim 3, wherein in the position of minimum expansion the movable wall (16) confers to the end part (9) of the first exhaust duct (7) a convergent conformation which progressively reduces an area of a cross section approaching the first outlet opening (10).

6. The exhaust system (6) according to claim 1, wherein:

the end part (9) of the first exhaust duct (7) has two mutually opposite movable walls (16); and the actuator device (17) is configured to move the two movable walls (16) together in opposite directions so as to move the two movable walls (16) apart or to move the movable walls (16) close to each other.

7. The exhaust system (6) according to claim 6, wherein:

the two movable walls (16) are hinged to rotate around two respective rotation axes (18) parallel to each other; the end part (9) of the first exhaust duct (7) has two fixed walls (19) parallel to each other which are perpendicular to the rotation axes (18); and the two movable walls (16) are enclosed between the fixed walls (19) and crawl on the fixed walls (19) when they move.

8. The exhaust system (6) according to claim 1 and comprising:

a second exhaust duct (11) which originates from the first exhaust duct (7) at a junction (12) and has a second outlet opening (13) through which the exhaust gases are released into the atmosphere; and a silencing device (14) which is arranged along the second exhaust duct (11).

9. The exhaust system (6) according to claim 8 and comprising a regulation valve (15), which is arranged along the first exhaust duct (7) downstream of the junction (12) from which the second exhaust duct (11) originates and is adapted to regulate the flow of exhaust gases towards the end part (9) of the first exhaust duct (7).

10. The exhaust system (6) according to claim 8, wherein the first exhaust duct (7) is completely free from any silencing device other than the movable wall (16) arranged upstream of the movable wall (16) and, hence, the silencing device (14) is only and exclusively arranged along the second exhaust duct (11).

11. The exhaust system (6) according to claim 1, wherein:

a regulation valve (15) is provided, which intercepts the first exhaust duct (7) and is movable between a fully open position and a fully closed position; and in the fully closed position the regulation valve (15) has a free section for the passage of the exhaust gas having a non-zero area so that the exhaust gases can pass through the regulation valve (15) even when the valve (15) is in the fully closed position.

12. The exhaust system (6) according to claim 1, wherein the control unit (20) is configured to move, by controlling the actuator device (17), the movable wall (16) towards a position of minimum expansion at low rotation speeds and at low engine loads of the internal combustion engine (4) and to move the movable wall (16) towards a maximum expansion position at high rotation speeds and high engine loads of the internal combustion engine (4).

13. The exhaust system (6) according to claim 1, wherein the control unit (17) is configured to vary, by controlling the actuator device (17), the position of the movable wall (16) also depending on: a gear engaged in a gearbox coupled to the internal combustion engine (4), a longitudinal speed of a vehicle (1) equipped with the internal combustion engine (4), and a longitudinal acceleration of the vehicle (1) equipped with the internal combustion engine (4).

14. The exhaust system (6) according to claim 13, wherein the control unit (20) is configured to move, by controlling the actuator device (17), the movable wall (16) towards a minimum expansion position in low gears and to move the movable wall (16) towards a maximum expansion position in high gears.

15. The exhaust system (6) according to claim 1, wherein the control unit (20) is configured to detect: the rotation speed of the internal combustion engine (4), the engine load of the internal combustion engine (4), a gear engaged in a gearbox coupled to the internal combustion engine (4), a longitudinal speed of a vehicle (1) equipped with the internal combustion engine (4), and/or a longitudinal acceleration of the vehicle (1) equipped with the internal combustion engine (4).

16. A vehicle (1) comprising:

at least two drive wheels (3);

an internal combustion engine (4), which causes the two drive wheels (3) to rotate with the interposition of a gearbox and is provided with an exhaust system (6) according to claim 1.

17. An exhaust system (6) for an internal combustion engine (4) and comprising:

at least one first exhaust duct (7) which originates from the internal combustion engine (4) and has an end part (9) which ends with a first outlet opening (10) through which the exhaust gases are released into the atmosphere; wherein the end part (9) of the first exhaust duct (7) has at least one movable wall (16) which can be moved to different positions to vary the width of the outlet opening (10);

a motor-driven actuator device (17), which is configured to actively move the movable wall (16) and can be electronically controlled;

a control unit (17), which is configured to vary, by controlling the actuator device (17), the position of the movable wall (16) depending on a rotation speed of the internal combustion engine (4) and on an engine load of the internal combustion engine (4);

a second exhaust duct (11) which originates from the first exhaust duct (7) at a junction (12) and has a second outlet opening (13) through which the exhaust gases are released into the atmosphere;

a silencing device (14) which is arranged along the second exhaust duct (11); and a regulation valve (15), which is arranged along the first exhaust duct (7) downstream of the junction (12) from which the second exhaust duct (11) originates and is adapted to regulate the flow of exhaust gases towards the end part (9) of the first exhaust duct (7).

18. The exhaust system (6) according to claim 17, wherein the first exhaust duct (7) is completely free from any silencing device other than the movable wall (16) arranged upstream of the movable wall (16) and, hence, the silencing device (14) is only and exclusively arranged along the second exhaust duct (11).

19. The exhaust system (6) according to claim 17, wherein:

the end part (9) of the first exhaust duct (7) has two mutually opposite movable walls (16); and the actuator device (17) is configured to move the two movable walls (16) together in opposite directions so as to move the two movable walls (16) apart or to move the movable walls (16) close to each other.

20. The exhaust system (6) according to claim 19, wherein:

the two movable walls (16) are hinged to rotate around two respective rotation axes (18) parallel to each other; the end part (9) of the first exhaust duct (7) has two fixed walls (19) parallel to each other which are perpendicular to the rotation axes (18); and the two movable walls (16) are enclosed between the fixed walls (19) and crawl on the fixed walls (19) when they move.

21. The exhaust system (6) according to claim 17, wherein the control unit (20) is configured to move, by controlling the actuator device (17), the movable wall (16) towards a position of minimum expansion at low rotation speeds and at low engine loads of the internal combustion engine (4) and to move the movable wall (16) towards a maximum expansion position at high rotation speeds and high engine loads of the internal combustion engine (4).

22. An exhaust system (6) for an internal combustion engine (4) and comprising:

at least one first exhaust duct (7) which originates from the internal combustion engine (4) and has an end part (9) which ends with a first outlet opening (10) through which the exhaust gases are released into the atmosphere; wherein the end part (9) of the first exhaust duct (7) has at least one movable wall (16) which can be moved to different positions to vary the width of the outlet opening (10);

a motor-driven actuator device (17), which is configured to actively move the movable wall (16) and can be electronically controlled;

a control unit (17), which is configured to vary, by controlling the actuator device (17), the position of the movable wall (16) depending on a rotation speed of the internal combustion engine (4) and on an engine load of the internal combustion engine (4); and a regulation valve (15), which intercepts the first exhaust duct (7) and is movable between a fully open position and a fully closed position;

wherein in the fully closed position the regulation valve (15) has a free section for the passage of the exhaust gas having a non-zero area so that the exhaust gases can pass through the regulation valve (15) even when the valve (15) is in the fully closed position.

23. The exhaust system (6) according to claim 22, wherein:

the end part (9) of the first exhaust duct (7) has two mutually opposite movable walls (16); and the actuator device (17) is configured to move the two movable walls (16) together in opposite directions so as to move the two movable walls (16) apart or to move the movable walls (16) close to each other.

24. The exhaust system (6) according to claim 23, wherein:

the two movable walls (16) are hinged to rotate around two respective rotation axes (18) parallel to each other; the end part (9) of the first exhaust duct (7) has two fixed walls (19) parallel to each other which are perpendicular to the rotation axes (18); and the two movable walls (16) are enclosed between the fixed walls (19) and crawl on the fixed walls (19) when they move.

25. The exhaust system (6) according to claim 22, wherein the control unit (20) is configured to move, by controlling the actuator device (17), the movable wall (16) towards a position of minimum expansion at low rotation speeds and at low engine loads of the internal combustion engine (4) and to move the movable wall (16) towards a maximum expansion position at high rotation speeds and high engine loads of the internal combustion engine (4).

* * * * *